United States Patent [19]

Danko

[11] Patent Number: 4,841,999

[45] Date of Patent: Jun. 27, 1989

[54] BRAKE DURM CLEANER ASSEMBLY AND METHOD OF CLEANING

[76] Inventor: Donald Danko, 23530 Daisetta, Newhall, Calif. 91321

[21] Appl. No.: 87,916

[22] Filed: Aug. 21, 1987

[51] Int. Cl.[4] ..... B08B 3/02

[52] U.S. Cl. ..... 134/22.1; 15/90; 15/345; 134/22.12; 134/21; 134/123; 134/169 A; 134/169 C; 134/121; 134/131; 188/78; 239/557; 239/558; 239/559

[58] Field of Search ..... 134/22.1, 22.12, 6, 134/7, 8, 9, 21, 123, 169 A, 166 R, 121, 131; 15/90, 345; 239/557, 558, 559; 188/78, 332

[56] References Cited

U.S. PATENT DOCUMENTS

| | | | |
|---|---|---|---|
| 3,139,100 | 6/1964 | Griparis | 134/169 R |
| 3,972,089 | 8/1976 | Parks | 15/345 |
| 4,017,329 | 4/1977 | Larson | 134/22.12 |
| 4,670,062 | 6/1987 | Lester | 134/21 |
| 4,711,259 | 12/1982 | Martin, Jr. et al. | 134/166 R |

*Primary Examiner*—Asok Pal

*Attorney, Agent, or Firm*—John J. Posta, Jr.

[57] ABSTRACT

The brake drum cleaner assembly includes a water hose, and a unitary spray adapter of plastic or the like releasably connected by a clamp or the like to the water hose. The adapter has a rear tubular stem portion inserted in one end of the hose and connected to a front expended spray head portion defining a plurality of water spray orifices. The front head portion can be cylindrical, spherical or anotehr shape and the orifices can be round, elongated, curved, etc. The exterior of the rear stem portion of the adapter may be convoluted, stepped, etc., to facilitate anchoring in the water hose. A water pulsator can be connected to the rear end of the adapter to cause water passing through the adapter to pulse outer the orifices for improved cleaning. The method includes drilling a hole through a brake backing plate, then passing the rear stem portion of the adapter out therethrough and connecting to the water hose, while leaving the spray front head portion within the drum cavity. Water is then passed through the hose and adapter so as to spray out of the adapter head into the drum interior in order to clean it and remove salt water, salt deposits, dirt, grime, etc., for improved functioning and corrosion resistance.

12 Claims, 1 Drawing Sheet

BRAKE DURM CLEANER ASSEMBLY AND METHOD OF CLEANING

BACKGROUND OF THE INVENTION

1. Field of the Invention

The present invention generally relates to cleaning means and methods and, more particularly, to an improved method and assembly for cleaning a brake drum.

2. Prior Art

After a boat trailer is backed into salt water in order to launch or pick up a boat, the trailer must be washed with fresh non-salt water in order to prevent salt water corrosion of the trailer's metal parts. Unfortunately, water hosing down of the trailer does not rid the trailer's brake drums of salt water. Leaving such salt water in place eventually badly corrodes and impairs the function and life of the brake drums and brake actuating mechanism. There are also other circumstances in which a vehicle's brake drums can become filled with water, mud, dirt and debris and need cleaning in order for them to function properly.

Accordingly, there is a need for a means and a method of cleaning a brake drum to rid it of salt water, mud, dirt, debris, etc., in order to maintain its proper function and longevity and prevent its corrosion.

SUMMARY OF THE INVENTION

The improved assembly and method of the present invention satisfy all the foregoing needs. The assembly and method are substantially as set forth in the Abstract.

Thus, a brake drum can be cleaned to remove salt water, salt, mud, dirt, debris, etc. by drilling a hole in the brake backing plate and passing the rear portion or stem of a novel spray adapter out therethrough, leaving the expanded front spray head portion inside the drum. The stem is then connected to a water hose, as by a clamp, and water is passed through the hose and adapter into the brake drum interior as a plurality of jets or sprays of water. In this regard, the adapter head has a number of spaced spray orifices, rounded, or elongated, narrow, curved, etc.

The head is cylindrical, spherical or another shape. The adapter may be unitary and made of plastic, for example, nylon, polypropylene, etc., and can have a stepped or convoluted rear stem exterior surface to facilitate locking it in the water hose. A water pulsator can be connected to the rear end of the adapter in the hose to deliver pulsed jets of water from the adapter for improved cleaning. Water from the adapter can drain out the space between the brake drum and brake backing plate. Further features of the invention are set forth in the following detailed description and accompanying drawings.

DRAWINGS

DETAILED DESCRIPTION

FIGS. 1–3

Figure 1:
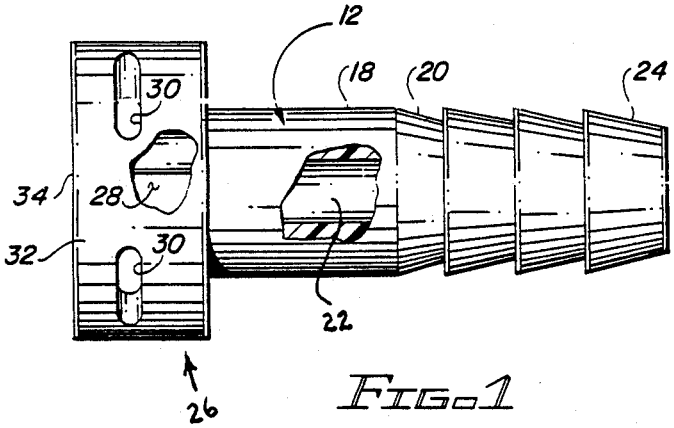
FIG. 1 is an enlarged schematic side elevation, partly broken away, of an adapter used in a first preferred embodiment of the improved assembly of the present invention.
Figure 2:
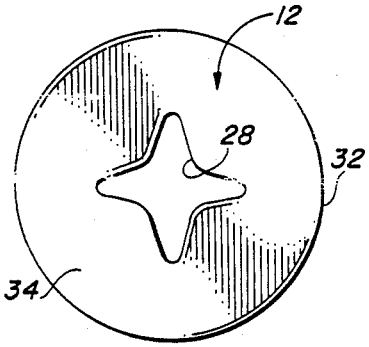
FIG. 2 is an enlarged schematic front elevation of the adapter of FIG. 1.
Figure 3:
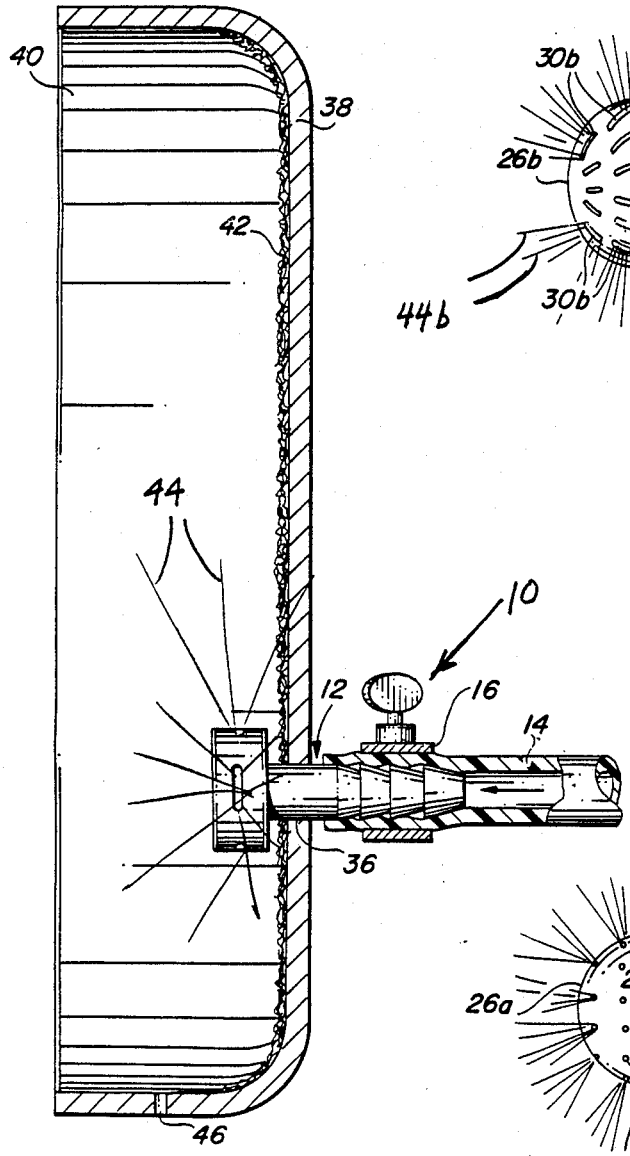
FIG. 3 is a schematic side elevation, partly broken away and partly in section, of the improved assembly of the present invention for practicing the method of the present invention, utilizing the adapter of FIGS. 1 and 2.

Now referring more particularly to FIGS. 1–3 of the accompanying drawings, a first preferred embodiment of the adapter method and assembly of the present invention are schematically depicted therein. Thus, FIG. 3 shows assembly 10 which comprises a novel spray adapter 12, a water hose 14 and means comprising a c-clamp 16 for releasably connecting adapter 12 to hose 14.

Adapter 12 comprises a body 18, preferably of plastic such as nylon, polytetrafluoroethylene, polypropylene or the like, but which also can be of metal, ceramic, cermet or the like. Body 18 is unitary and has a generally tubular rear stem portion 20 having a central passageway 22 longitudinally therethrough and a three-stepped convoluted rear area 24 to facilitate anchoring it in hose 14 (FIG. 3).

Body 18 also includes an expanded front spray head portion 26 connected to stem 20 and including a central cavity 28 connected to passageway 22 and to a plurality of spaced, narrow, elongated spray orifices or slits 30 in the sides 32 and front 34. Orifice 28 in front 34 is cross-shaped.

In accordance with the present method of cleaning a brake drum, and brake actuating mechanism, a hole 36 is first drilled through brake drum backing plate 38 from the interior thereof to the exterior 40 thereof in which undesired materials such as salt water, mud, dirt and debris 42 can collect (FIG. 3). The stem 20 is pushed out through hole 36 and releasably connected at area 24, as by clamp 16, to water hose 14 slipped thereover, leaving head 26 in the exterior 40 of drum backing plate 38.

Cleaning water is then passed through hose 14 and adapter 12, exiting head 26 through orifice 30 as a series of fine spray jets 44, easily spraying off mud, dirt, salt and debris from drum 38 and washing it and residual salt water away, all of which can drain out through the space between the brake drum and the brake backing plate.

Accordingly, assembly 10 is simple, efficient and easily and effectively used in the present method. Adapter 12 can be made in any suitable size and shape. For example, it can be about $1\frac{3}{4}$ inches long, with a $\frac{7}{8}$ inch diameter head 26 and $\frac{1}{2}$ inch diameter stem 20 which may be about $1\frac{1}{4}$ inches long.

FIG. 4

Figure 4:
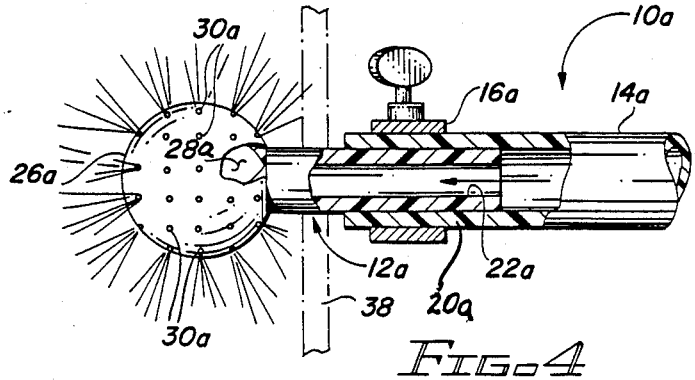
FIG. 4 is a schematic side elevation, partly in section, of a second preferred embodiment of the improved assembly of the present invention; and, FIG. 5 is a schematic side elevation, partly in section, of a third preferred embodiment of the improved assembly of the present invention.

A second preferred embodiment of the improved assembly of the present invention is schematically depicted in FIG. 4. Thus, assembly **10*a* is shown. Components thereof similar to those of assembly 10** bear the same numerals, but are succeeded by the letter "a".

Assembly **10*a* ,includes adapter 12*a* having a straight tubular stem 20*a* with central passageway 22*a* therein connected to space 28*a* in spherical head 26*a*. Round orifices 30*a* are also connected to space 28*a*. Adapter 12*a* is connected by clamp 16*a* to hose 14*a* to complete assembly 10*a*. Assembly 10*a* has substantially the features of assembly 10** and can be made of similar materials.

FIG. 5.

Figure 5:
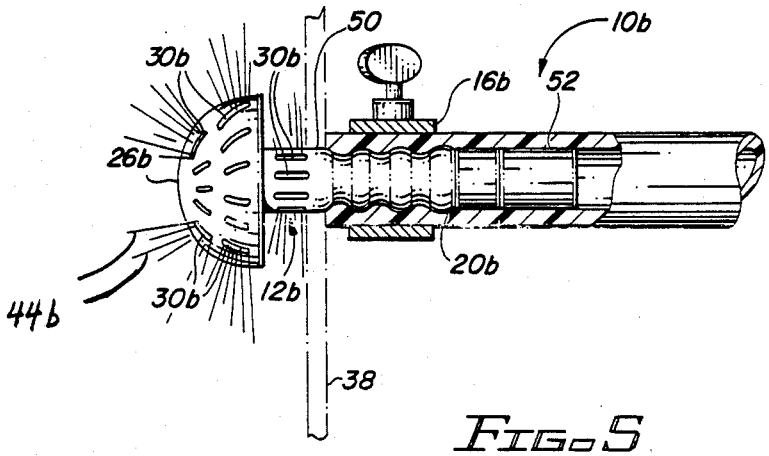

A third preferred embodiment of the improved cleaning assembly of the present invention is schematically depicted in FIG. 5. Thus, assembly **10*b* is shown. Components thereof similar to those of assembly 10 or 10*a*** bear the same numerals but are succeeded by the letter "b".

Assembly **10*b* includes hose 14*b* connected through clamp 16*b* to rear stem 20*b* of adapter 12*b*. Stem 20*b* has an undulating rather than tri-stepped area 24*b* to facilitate clamping to hose 14*b*. The front area 50 of stem 20*b* has orifices 30*b* in addition to the elongated curved orifices 30*b* in generally oval shaped head 26*b*. Otherwise, adapter 12*b* is identical in function and construction to adapters 12 and 12*a*. Assembly 10*b* has functions and advantages similar to those of assembly 10 and 10*a***.

In addition to the above, assembly **10*b* includes a conventional water pulsating unit or chamber 52 of any suitable type, such as a movable in-stream ball or the like. Chamber 52 is connected to the rear end of stem 20*b* and disposed in hose 14*b* so that all water which passes through hose 14*b* and into adapter 12*b* is pulsed by chamber 52, causing water jets 44*b*** to be pulsed into the brake drum for greater cleaning ability.

Various modifications, changes, alterations and additions can be made in the improved assembly and method of the present invention, their components, steps and parameters. All such modifications, changes, alterations and additions as are within the scope of the appended claims form part of the present invention.

What is claimed is:

1. An improved brake drum cleaner assembly, comprising, in combination:

(a) a water hose;

(b) a spray adapter, said adapter comprising a body having an elongated generally rear stem tubular portion having a generally central water passageway, said tubular portion being releasably secured in the front end of said water hose, and an expanded front spray head portion connected to said rear portion and having a generally central space connected to said passageway, said front portion defining a plurality of spaced orifices connected to said central space for delivery of cleaning water to the interior of a brake drum;

(c) said rear stem portion releasably secured to and lying outside a brake backing plate, (d) said spray head releasably secured to and lying inside said brake backing plate, and (e) connector means for releasably connecting said body to said hose, (f) wherein water can be introduced through said water hose to flush out a brake drum.

2. The improved assembly of claim 1 wherein said front and rear portions of said body are integral, and wherein said front portion is generally cylindrical with said orifices in the sides and front thereof.

3. The improved assembly of claim 2 wherein said front orifices form a cross and said orifices are narrow elongated slits.

4. The improved assembly of claim 1 wherein said front portion is generally spherical with such orifices distributed throughout the outer surface thereof.

5. The improved assembly of claim 1 wherein said front portion is oval shaped, with curved orifices and wherein the front area of said rear portion includes orifices in the sides thereof.

6. The improved assembly of claim 1 wherein the rear area of said rear portion includes a stepped outer surface to facilitate clamping thereto.

7. The improved assembly of claim 1 wherein said assembly includes a water pulsater connected to said rear portion of said body for delivery of pulses of cleaning water to a brake drum and wherein said adapter is unitary and comprises plastic.

8. An improved method of cleaning a brake drum, said method comprising the steps of:

(a) drilling a hole in a brake backing plate so as to extend from the interior to the exterior thereof;

(b) inserting the rear, generally tubular portion of an adapter outwardly through said hole while retaining the front expanded portion of said adapter in the interior of said backing plate, said front portion having a generally central cavity communicating with spaced orifices in the sides and front thereof and with a generally central passageway in said rear portion;

(c) connecting one end of a water hose to said adapter rear portion and delivering cleaning water through said hose, generally central adapter passageway, generally central cavity and orifices to the interior of said brake drum to remove salt water, salt deposits, dirt and debris therefrom for improved performance and corrosion prevention.

9. The improved method of claim 8 wherein said water hose is clamped to an outer convoluted area of said rear portion of said adapter, wherein said adapter front portion is generally cylindrical, and wherein said spaced orifices are elongated slits.

10. The improved method of claim 8 wherein said front portion is generally spherical with said orifices distributed over substantially the major area thereof.

11. The improved method of claim 8 wherein said front portion is oval, with curved orifices and wherein said rear portion includes certain of said orifices.

12. The improved method of claim 8 wherein said cleaning water is pulsed through said adapter to said brake drum interior.

* * * * *